US010535453B2

(12) United States Patent
Takajo et al.

(10) Patent No.: US 10,535,453 B2
(45) Date of Patent: Jan. 14, 2020

(54) GRAIN-ORIENTED ELECTRICAL STEEL SHEET AND METHOD FOR MANUFACTURING THE SAME

(71) Applicant: JFE STEEL CORPORATION, Chiyoda-ku, Tokyo (JP)

(72) Inventors: Shigehiro Takajo, Tokyo (JP); Hirotaka Inoue, Tokyo (JP); Seiji Okabe, Tokyo (JP); Kazuhiro Hanazawa, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 694 days.

(21) Appl. No.: 14/439,104

(22) PCT Filed: Oct. 29, 2013

(86) PCT No.: PCT/JP2013/006401
§ 371 (c)(1),
(2) Date: Apr. 28, 2015

(87) PCT Pub. No.: WO2014/068962
PCT Pub. Date: May 8, 2014

(65) Prior Publication Data

US 2015/0310973 A1 Oct. 29, 2015

(30) Foreign Application Priority Data

Oct. 31, 2012 (JP) ..... 2012-240667

(51) Int. Cl.
*H01F 1/16* (2006.01)
*C21D 1/34* (2006.01)
(Continued)

(52) U.S. Cl.
CPC ..... *H01F 1/14775* (2013.01); *C21D 1/34* (2013.01); *C21D 1/38* (2013.01); *C21D 6/008* (2013.01);
(Continued)

(58) Field of Classification Search
CPC ..... C22C 38/02
(Continued)

(56) References Cited

U.S. PATENT DOCUMENTS 4,915,750 A * 4/1990 Salsgiver ..... C21D 8/1294 148/112
5,411,604 A 5/1995 Inokuti
(Continued)

FOREIGN PATENT DOCUMENTS

EP 0331498 9/1989
EP 0897016 2/1999
(Continued)

OTHER PUBLICATIONS

Chinese Office Action dated Dec. 28, 2015 for Chinese Application No. 201380056564.0 with Search Report as partial translation.
(Continued)

*Primary Examiner* — Brian D Walck
(74) *Attorney, Agent, or Firm* — RatnerPrestia

(57) ABSTRACT

The present invention provides a grain-oriented electrical steel sheet with reduced iron loss over a wide range of sheet thickness by providing a grain-oriented electrical steel sheet with an actually measured sheet thickness t (mm) that includes a closure domain region extending linearly in a direction from 60° to 120° with respect to the rolling direction on a surface of the steel sheet, the closure domain region being formed periodically at a spacing s (mm) in the rolling direction, such that $h \geq 74.9t+39.1$ ($0.26 \geq t$), $h \geq 897t-174.7$ ($t>0.26$), $(w \times h)/(s \times 1000) \leq -12.6t+7.9$ ($t>0.22$), and $(w \times h)/(s \times 1000) \leq -40.6t+14.1$ ($t \leq 0.22$), where h (μm) is the depth and w (μm) is the width of the closure domain region.

5 Claims, 7 Drawing Sheets

(51) Int. Cl.

| | |
|---|---|
| ***C21D 9/46*** | (2006.01) |
| ***C22C 38/02*** | (2006.01) |
| ***H01F 1/147*** | (2006.01) |
| ***C21D 1/38*** | (2006.01) |
| ***C21D 6/00*** | (2006.01) |
| ***H01F 41/00*** | (2006.01) |

(52) U.S. Cl.
CPC ..... *C21D 9/46* (2013.01); *C22C 38/02* (2013.01); *H01F 1/16* (2013.01); *H01F 41/00* (2013.01)

(58) Field of Classification Search
USPC ..... 148/320
See application file for complete search history.

(56) References Cited

U.S. PATENT DOCUMENTS

| | | | |
|---|---|---|---|
| 2001/0032684 | A1 | 10/2001 | Sakai |
| 2008/0265688 | A1 | 10/2008 | Nakano |
| 2013/0130043 | A1 | 5/2013 | Omura |

FOREIGN PATENT DOCUMENTS

| | | |
|---|---|---|
| EP | 2891726 | 7/2005 |
| EP | 2602339 | 6/2013 |
| JP | 04362139 | 12/1992 |
| JP | 05179355 | 7/1993 |
| JP | 05335128 | 12/1993 |
| JP | 062042 | 1/1994 |
| JP | 0622179 | 3/1994 |
| JP | 11279645 | 10/1999 |
| JP | 2000328139 | 11/2000 |
| JP | 2002012918 | 1/2002 |
| JP | 2006233299 | 9/2006 |
| JP | 4344264 | 10/2009 |
| JP | 4705382 | 6/2011 |
| JP | 2011246782 | 12/2011 |
| JP | 2012001741 | 1/2012 |
| JP | 2012036445 | 2/2012 |
| JP | 2012052230 | 3/2012 |
| JP | 2012052233 | 3/2012 |
| JP | 2012057232 | 3/2012 |
| JP | 2012067349 | 4/2012 |

OTHER PUBLICATIONS

Extended European Search Report dated Mar. 8, 2016 for European Application No. 13851438.5-1362.
Korean Office Action dated Apr. 20, 2016 for Korean Application No. 2015-7011081, including Concise Statement of Relevance.
Kim, M. et al., "A low-energy compact electron beam irradiator for core-less reduction of silicon steel," Nov. 29, 2001, pp. 2117-2120, vol. 3, IECON'01: Proceedings of the 27th Annual Conference of the IEEE Industrial Electronics Society, Denver, CO Nov. 29-Dec. 2, 2001.
IEEE Transactions on Magnetics, "Improvement of Magnetic Properties in Thinner HI-B with Domain-Refinement," vol. MAG-20, No. 5, Sep. 1984, p. 1557-1559.
International Search Report for International Application No. PCT/JP2013/006401 dated Jan. 28, 2014.
Japanese Office Action dadted Apr. 1, 2014 in Japanese Application No. JP2013-555498, with English language translation.

* cited by examiner

GRAIN-ORIENTED ELECTRICAL STEEL SHEET AND METHOD FOR MANUFACTURING THE SAME

CROSS REFERENCE TO RELATED APPLICATIONS

This is the U.S. National Phase application of PCT/JP2013/006401, filed Oct. 29, 2013, which claims priority to Japanese Patent Application No. 2012-240667, filed Oct. 31, 2012, the disclosures of these applications being incorporated herein by reference in their entireties for all purposes.

TECHNICAL FIELD OF THE INVENTION

The present invention relates to a grain-oriented electrical steel sheet for use in an iron core of a transformer or the like and to a method for manufacturing the grain-oriented electrical steel sheet.

BACKGROUND OF THE INVENTION

In recent years, energy use has become more efficient, and demand has emerged for a reduction in energy loss at the time of operation, for example in a transformer.

The loss occurring in a transformer is mainly composed of copper loss occurring in conducting wires and iron loss occurring in the iron core.

Iron loss can be further divided into hysteresis loss and eddy current loss. To reduce the former, measures such as improving the crystal orientation of the material and reducing impurities have proven effective. For example, JP 2012-1741 A (PTL 1) discloses a method for manufacturing a grain-oriented electrical steel sheet with excellent flux density and iron loss properties by optimizing the annealing conditions before final cold rolling.

On the other hand, in addition to reducing sheet thickness and increasing the added amount of Si, the eddy current loss is also known to improve dramatically by the formation of a groove or the introduction of strain on the surface of the steel sheet.

For example, JP H06-22179 B2 (PTL 2) discloses a technique for forming a linear groove, with a groove width of 300 μm or less and a groove depth of 100 μm or less, on one surface of a steel sheet so as to reduce the iron loss $W_{17/50}$, which was 0.80 W/kg or more before groove formation, to 0.70 W/kg or less.

JP 2011-246782 A (PTL 3) discloses a technique for irradiating a secondary recrystallized steel sheet with a plasma arc so as to reduce the iron loss $W_{17/50}$, which was 0.80 W/kg or more before irradiation, to 0.65 W/kg or less.

Furthermore, JP 2012-52230 A (PTL 4) discloses a technique for obtaining material for a transformer with low iron loss and little noise by optimizing the coating thickness and the average width of a magnetic domain discontinuous portion formed on the surface of a steel sheet by electron beam irradiation.

It is known, however, that the iron loss reduction effect achieved by such groove formation or introduction of strain differs depending on the sheet thickness of the material. For example, IEEE TRANSACTIONS ON MAGNETICS, VOL. MAG-20, NO. 5, p. 1557 (NPL 1) describes how, as the sheet thickness increases, the amount of reduction in iron loss due to laser irradiation tends to decrease and notes a difference of approximately 0.05 W/kg in the amount of reduction in iron loss ($\Delta W_{17/50}$) between sheet thicknesses of 0.23 mm and 0.30 mm for a material with a flux density of 1.94 T.

Against this background, studies have been made of whether the effect of reducing iron loss of thick sheet material can be improved even slightly by adjusting the magnetic domain refining method. For example, JP 2000-328139 A (PTL 5) and JP 4705382 B2 (PTL 6) disclose techniques for improving the effect of reducing iron loss of a grain-oriented electrical steel sheet from thick sheet material by optimizing the laser irradiation conditions in accordance with the sheet thickness of the material. In particular, PTL 6 discloses having obtained extremely low iron loss by setting the strain ratio η to 0.00013 or more and 0.013 or less.

This strain ratio η is the ratio of the strain area within a rolling direction cross-section of the steel sheet and is expressed by the formula $\eta/8\times(w\times w)/(t\times PL)$, where t is the thickness of the steel sheet, w is the closure domain width in the rolling direction, and PL is the laser irradiation spacing in the rolling direction.

PATENT LITERATURE

PTL 1: JP 2012-1741 A
PTL 2: JP H06-22179 B2
PTL 3: JP 2011-246782 A
PTL 4: JP 2012-52230 A
PTL 5: JP 2000-328139 A
PTL 6: JP 4705382 B2
PTL 7: JP H11-279645 A
PTL 8: JP 4344264 B2
Non-Patent Literature
NPL 1: IEEE TRANSACTIONS ON MAGNETICS, VOL. MAG-20, NO. 5, p. 1557

SUMMARY OF INVENTION

The inventors of the present invention conjectured that such a technique used in a laser method could also be applied to an electron beam method and therefore investigated the relationship between the strain ratio and iron loss in order to reduce the iron loss of a steel sheet. FIG. 1 illustrates the effect of the strain ratio η on the iron loss after electron beam irradiation of a sheet with a sheet thickness of 0.27 mm. FIG. 1 shows that iron loss of a steel sheet can be reduced, for example to $W_{17/50}<0.76$ W/kg, regardless of whether the strain ratio is 0.013 or more or is 0.013 or less.

Furthermore, when the strain ratio is in a range of 0.013 or less and 0.00013 or more as well, the iron loss is sometimes a high value of 0.78 W/kg or more, clearly showing that low iron loss is not always obtained.

The inventors assumed that the above results stem from a difference in principle between the electron beam method and the laser method and assumed that in the case of the electron beam method, a different strain distribution than that disclosed in PTL 6 would be formed. FIG. 2 illustrates the relationship between the width w and depth h of the closure domain occurring in the portions irradiated by the laser and electron beam. It was observed that when using a laser, as the width increases, the depth tends to increase at a degree of accuracy such that the correlation coefficient $R^2$ is approximately 0.45, whereas when using an electron beam, the correlation coefficient between width and depth was low, and no clear correlation could be observed.

The present invention has been conceived in light of the above circumstances and proposes a grain-oriented electrical steel sheet, and method for manufacturing the same, with reduced iron loss over a wide range of sheet thickness by forming a closure domain shape advantageous for iron loss reduction that utilizes electron beam characteristics and forming a closure domain that is appropriate for the sheet thickness.

Based on the above-described experiment results, the inventors conceived of separately controlling the width and the depth of the portion where the closure domain is formed in the portion irradiated during electron beam irradiation.

The inventors estimated, based on conventional knowledge, that to be advantageous for reducing iron loss, the portion where the closure domain is formed should be deep in the sheet thickness direction and have a small volume. The reason is that, for example in JP H11-279645 A (PTL 7), an increase in the depth in the sheet thickness direction has been shown to be advantageous for reducing the eddy current loss of material. Furthermore, JP 4344264 B2 (PTL 8) shows that since strain is accumulated in the portion where the closure domain is formed, shrinking the portion where the closure domain is formed is useful for suppressing deterioration of hysteresis loss.

The inventors realized that, as illustrated in FIG. 3, hysteresis loss worsens more when the sheet thickness is large, even for beam irradiation with the same conditions for irradiation energy and the like. In other words, the inventors posited that a thick sheet material should preferably be irradiated under conditions such that hysteresis loss does not worsen while maintaining the same depth of the portion where the closure domain is formed as in a thin sheet material, i.e. such that the portion where the closure domain is formed is made thinner.

FIG. 4 illustrates the effect of the depth of the portion where the closure domain is formed on the rate of improvement in eddy current loss with respect to the eddy current loss when the depth of the portion where the closure domain is formed is 45 μm.

FIG. 5 illustrates the effect of a volume index for the portion where the closure domain is formed (width×depth of the portion where the closure domain is formed/RD line spacing) on the rate of improvement in hysteresis loss with respect to the hysteresis loss when the volume index for the portion where the closure domain is formed is 1.1 μm.

FIGS. 4 and 5 show how the eddy current loss tends to improve for a larger depth of the portion where the closure domain is formed and how the hysteresis loss tends to worsen for a larger volume of the portion where the closure domain is formed.

FIG. 6 illustrates the depth of the portion where the closure domain is formed that is necessary to set the rate of improvement in eddy current loss, calculated based on the above results, to 3% or 5% (a more preferable condition).

FIG. 7 illustrates the volume index for the portion where the closure domain is formed that is necessary to set the rate of deterioration of hysteresis loss to 5% or 3% (a more preferable condition).

FIGS. 6 and 7 clearly show that the steel sheet thickness, depth, and width×depth/RD line spacing (volume index for the portion where the closure domain is formed) have a preferable relationship in a portion where the closure domain is formed that is advantageous for reducing iron loss.

Furthermore, through numerous experiments, the inventors identified that for a constant average beam scanning rate, the width of the portion where the closure domain is formed increases as the irradiation energy per unit scanning length of the beam and the beam diameter increase (where P>45 (J/m/mm)) and that the depth of the portion where the closure domain is formed is affected by the "irradiation energy per unit length/beam diameter" of the beam and by the acceleration voltage.

Additionally, FIG. 8 illustrates the effect of irradiation energy per unit scanning length on the width of the portion where the closure domain is formed.

FIG. 9 illustrates the effect of the beam diameter on the width of the portion where the closure domain is formed.

FIG. 10 illustrates the effect of P (irradiation energy per unit scanning length/beam diameter) on the depth of the portion where the closure domain is formed.

FIG. 11 illustrates the effect of the acceleration voltage on the depth of the portion where the closure domain is formed.

Based on these experiment results illustrated in FIGS. 8 to 11, assuming that the depth of the portion where the closure domain is formed is affected independently by the acceleration voltage Va and P, the inventors calculated the Va and P necessary to set the depth of the portion where the closure domain is formed to a predetermined value and discovered that a suitable relationship exists using the actually measured sheet thickness t.

The present invention is based on the above-described findings.

Specifically, primary features of the present invention include the following.

1. A grain-oriented electrical steel sheet with an actually measured sheet thickness t (mm), comprising a closure domain region extending linearly in a direction from 60° to 120° with respect to a rolling direction on a surface of the steel sheet, the closure domain region being formed periodically at a spacing s (mm) in the rolling direction, wherein $$h \geq 74.9t + 39.1 (0.26 \geq t),$$

$$h \geq 897t - 174.7 (t > 0.26),$$

$$(w \times h)/(s \times 1000) \leq -12.6t + 7.9 (t > 0.22), \text{ and}$$

$$(w \times h)/(s \times 1000) \leq -40.6t + 14.1 (t \leq 0.22),$$

where h (μm) is a depth and w (μm) is a width of the closure domain region, s (mm) is the spacing, and t (mm) is the actually measured sheet thickness.

2. A method for manufacturing the grain-oriented electrical steel sheet with an actually measured sheet thickness t (mm) of 1, comprising forming a closure domain region extending linearly in a direction from 60° to 120° with respect to a rolling direction on a surface of the steel sheet, the closure domain region being formed periodically at a spacing s (mm) in the rolling direction, by using an electron beam emitted at an acceleration voltage Va (kV), wherein $$(w \times h)/(s \times 1000) \leq -12.6t + 7.9 (t > 0.22), \text{ and}$$

$$(w \times h)/(s \times 1000) \leq -40.6t + 14.1 (t \leq 0.22),$$

where h (μm) is a depth and w (μm) is a width of the closure domain region, s (mm) is the spacing, and t (mm) is the actually measured sheet thickness, and $$Va \geq 580t + 270 - 6.7P (0.26 \geq t),$$

$$Va \geq 6980t - 1390 - 6.7P (t > 0.26), \text{ and}$$

$$P > 45,$$

where P is irradiation energy per unit scanning length/beam diameter (J/m/mm).

3. The method of 2, wherein the beam diameter of the electron beam is 400 μm or less.

4. The method of 2. or 3, wherein a $LaB_6$ cathode is used as an irradiation source of the electron beam.

According to the present invention, a closure domain shape advantageous for iron loss reduction that utilizes electron beam characteristics can be formed, and by forming a closure domain that is appropriate for the sheet thickness, iron loss can be reduced in a grain-oriented electrical steel sheet over a wide range of sheet thickness. Accordingly, the present invention allows for an increase in energy usage efficiency of a transformer produced with a grain-oriented electrical steel sheet of any sheet thickness and is therefore industrially useful.

BRIEF DESCRIPTION OF DRAWINGS

Exemplary embodiments of the present invention will be further described below with reference to the accompanying drawings, wherein.

DESCRIPTION OF EMBODIMENTS OF THE INVENTION

The present invention will be described in detail below with reference to exemplary embodiments.

The present invention provides a grain-oriented electrical steel sheet, and a preferable method for manufacturing the grain-oriented electrical steel sheet, that has a magnetic domain refined by irradiation with an electron beam.

Figure 12:
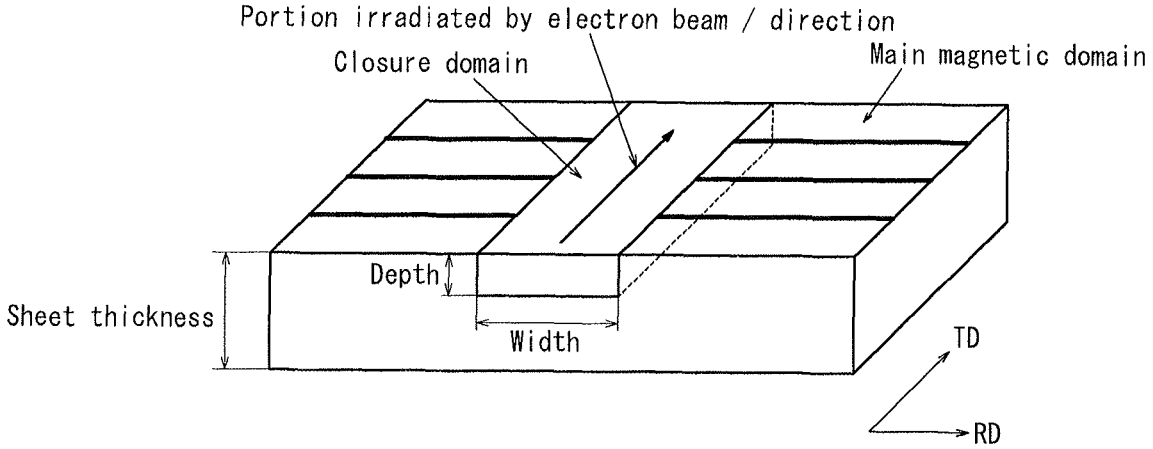
FIG. 12 illustrates a linear closure domain, formed at the time of emission of the electron beam, that segments the main magnetic domain.

An insulating coating may be formed on the electrical steel sheet irradiated with an electron beam, yet omitting the insulating coating poses no problem. As illustrated in FIG. 12, a linearly extending closure domain that segments the main magnetic domain is formed in the portion irradiated by the electron beam. The thickness of the grain-oriented electrical steel sheet used in the present invention is preferably, in industrial terms, approximately 0.1 mm to 0.35 mm. The present invention may be applied to any conventionally known grain-oriented electrical steel sheet, for example regardless of whether inhibitor components are included.

The grain-oriented electrical steel sheet of the present invention preferably has a linearly extending closure domain shape, as described below. Note that simply referring to a closure domain below designates a region with a linearly extending closure domain shape. Also note that a unit adjustment term has been included in the coefficient for the letters into which numerical values are substituted in the equations below. Therefore, the numerical values may be substituted as non-dimensional values, ignoring units.

[Volume of Portion where the Closure Domain is Formed]

Figure 7:
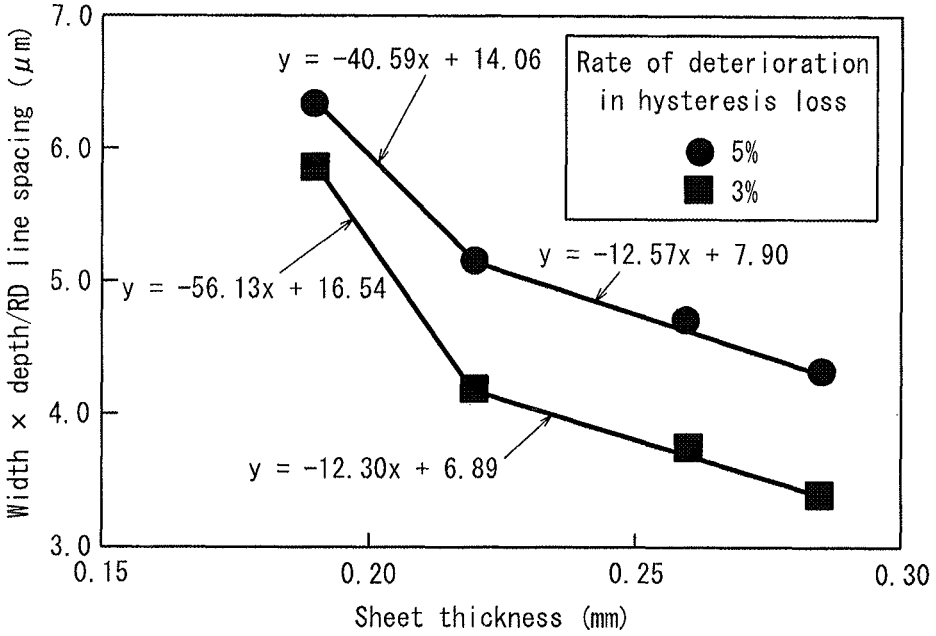
FIG. 7 illustrates the volume index for the portion where the closure domain is formed that is necessary to set the rate of hysteresis deterioration (absolute value of rate of improvement) to 5% or 3% (a more preferable condition)
Figure 8:
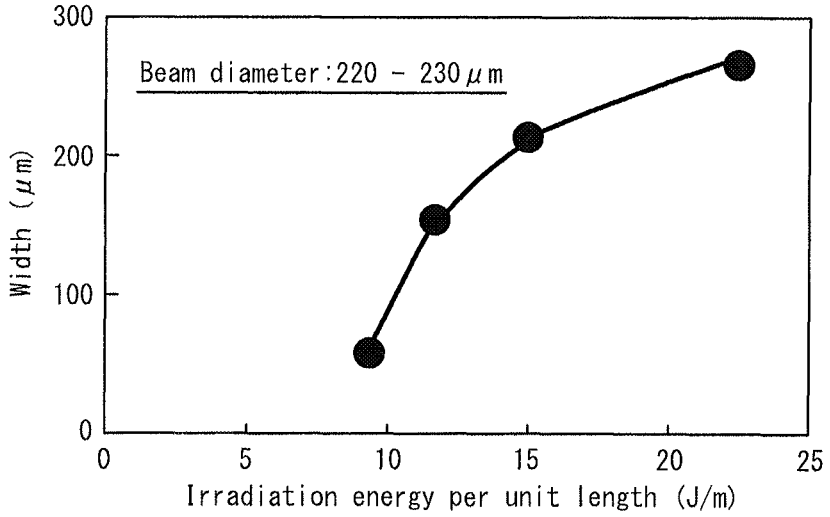
FIG. 8 illustrates the effect of irradiation energy per unit scanning length on the width of the portion where the closure domain is formed.
Figure 9:
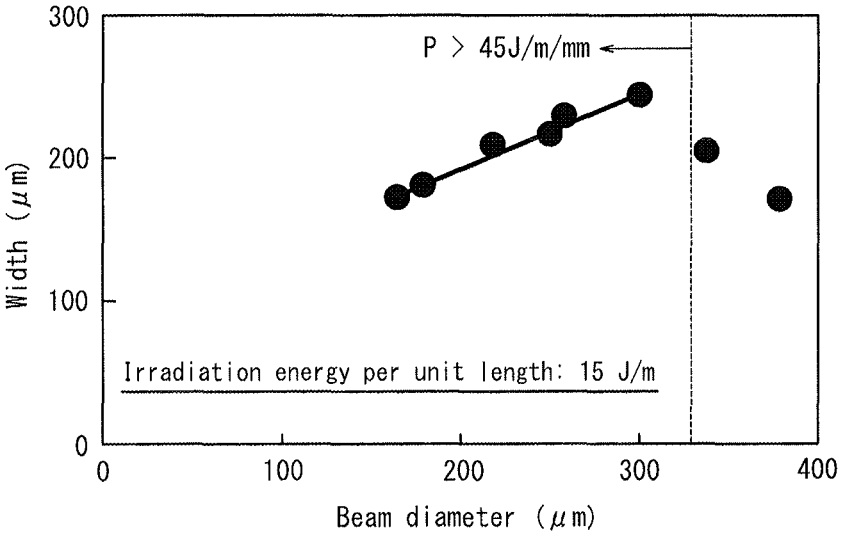
FIG. 9 illustrates the effect of the beam diameter on the width of the portion where the closure domain is formed.
Figure 10:
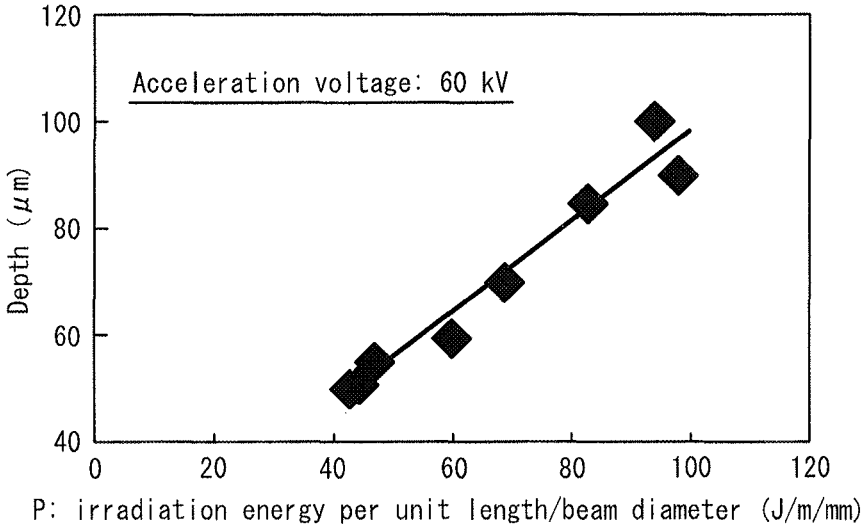
FIG. 10 illustrates the effect of P (irradiation energy per unit scanning length/beam diameter) on the depth of the portion where the closure domain is formed.
Figure 11:
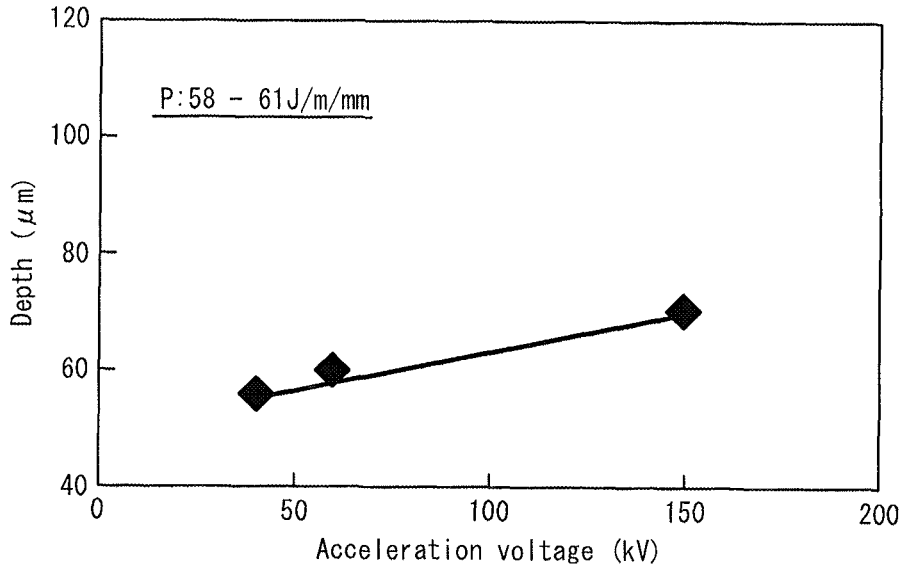
FIG. 11 illustrates the effect of the acceleration voltage on the depth of the portion where the closure domain is formed.

As illustrated in FIG. 7, the volume of the portion where the closure domain is formed is represented as a volume index for the portion where the closure domain is formed that is necessary to set the rate of hysteresis deterioration (absolute value of rate of improvement) to 5% or 3% as follows:

$$(w \times h)/(s \times 1000) \leq -12.6t + 7.9 (t > 0.22), \text{ and}$$

$$(w \times h)/(s \times 1000) \leq -40.6t + 14.1 (t \leq 0.22),$$

and more preferably $$(w \times h)/(s \times 1000) \leq -12.3t + 6.9 (t > 0.22), \text{ and}$$

$$(w \times h)/(s \times 1000) \leq -56.1t + 16.5 (t \leq 0.22),$$

where h (μm) is the depth of the closure domain, w (μm) is the width of the closure domain, s (mm) is the RD line spacing, and t (mm) is the actually measured thickness of the steel sheet (the same letters being used below).

Since strain is introduced, the portion where the closure domain is formed is not preferable from the perspective of reducing hysteresis loss, and the volume thereof is preferably small. The volume of the portion where the closure domain is formed is proportional to the value yielded by dividing the area of the closure domain shape in a rolling direction cross-section parallel to the sheet thickness direction, obtained by observing a sheet thickness cross-section in the rolling direction (i.e. the area of the cross-sectional shape), by the spacing of the closure domain formed periodically in the rolling direction (RD line spacing: s). Therefore, in the present invention, this area of the cross-sectional shape/RD line spacing is used as a volume index.

Considering how this area of the cross-sectional shape can vary along the line of the electron beam irradiation, the average area is preferably used. When variation in the area of the cross-sectional shape is large, it is possible to make measurement of only the closure domain shape observed in a sheet thickness cross-section in the rolling direction for a characteristic portion. For example, in test material irradiated with an electron beam in a dot pattern in the transverse direction (direction orthogonal to the rolling direction), the closure domain shape in a dot-centered portion may differ from the closure domain shape between dots, yet in this case, the average of the widths and depths yielded by observing cross-sections are preferably used.

[Depth of Portion where the Closure Domain is Formed]

Figure 1:
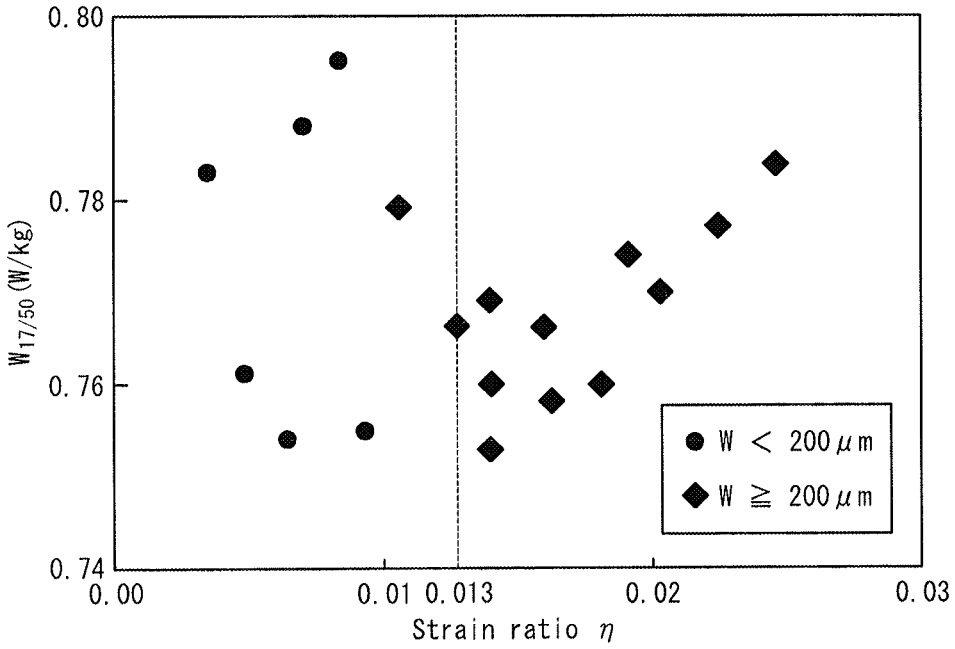
FIG. 1 illustrates the effect of the strain ratio η on the iron loss after electron beam irradiation of material with a sheet thickness of 0.27 mm.
Figure 2:
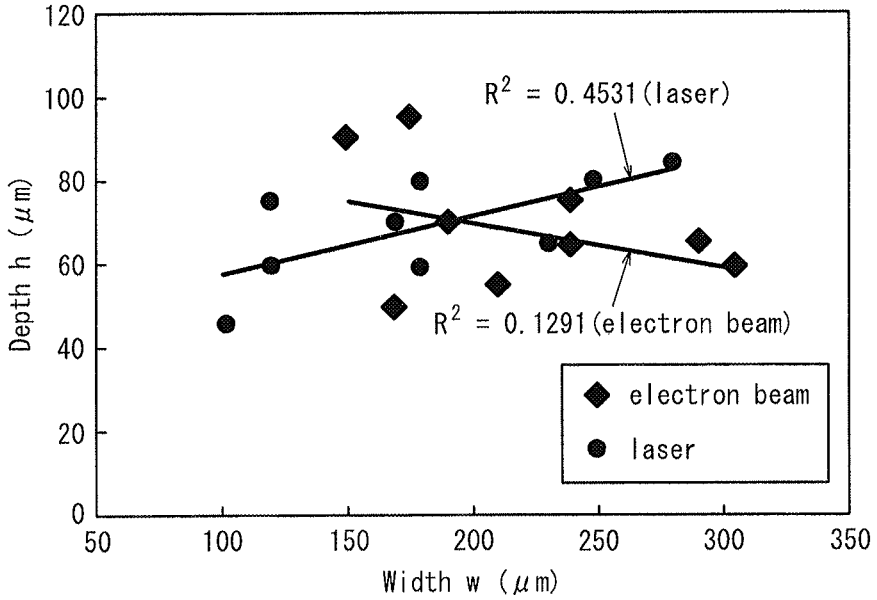
FIG. 2 illustrates the relationship between the width w and depth h of the closure domain occurring in the portions irradiated by the laser and electron beam.
Figure 3:
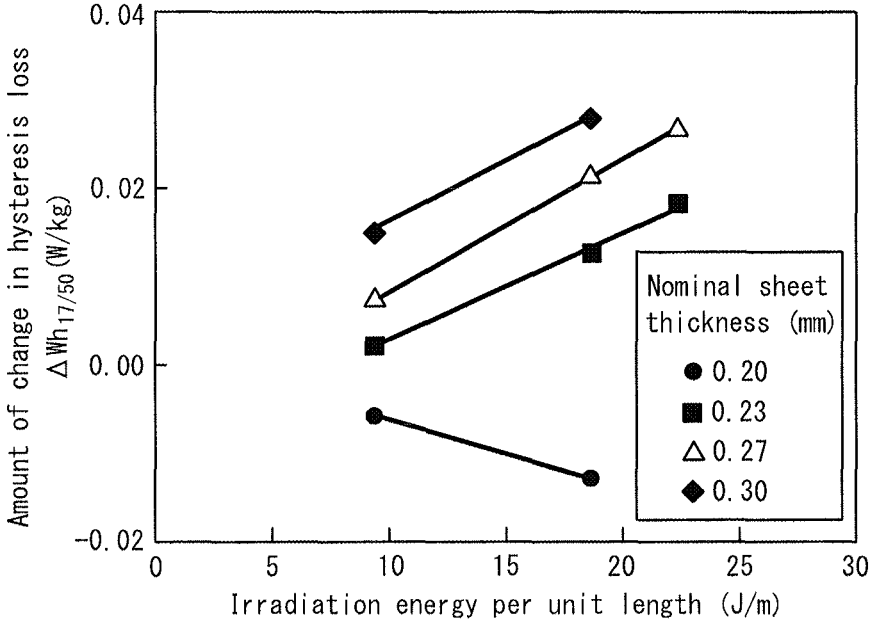
FIG. 3 illustrates the relationship between irradiation energy per unit length and the amount of change in hysteresis loss when varying the sheet thickness.
Figure 4:
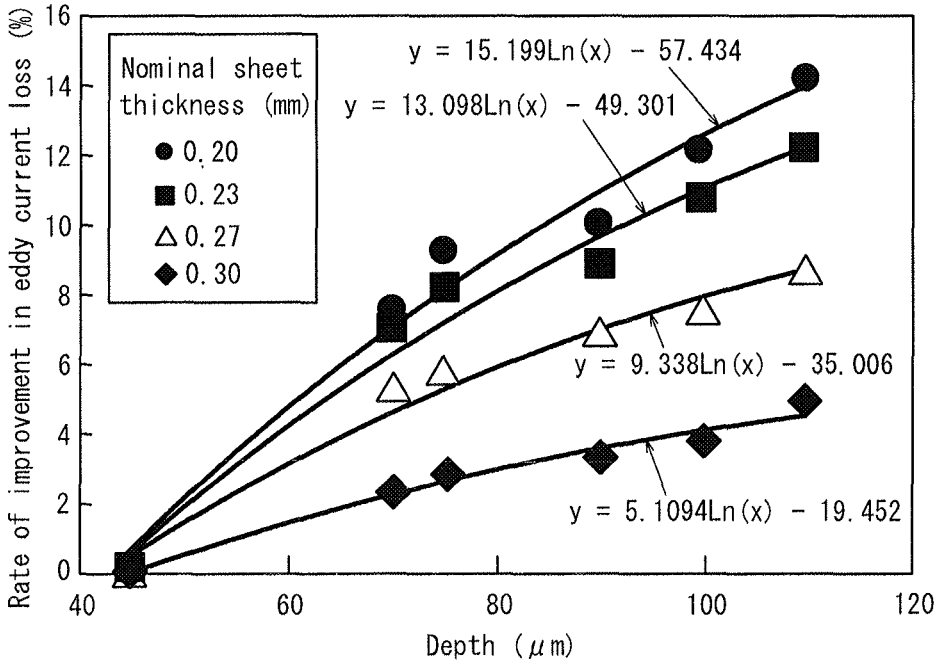
FIG. 4 illustrates the effect of the depth of the portion where the closure domain is formed on the rate of improvement in eddy current loss with respect to the eddy current loss when the depth of the portion where the closure domain is formed is 45 μm.
Figure 5:
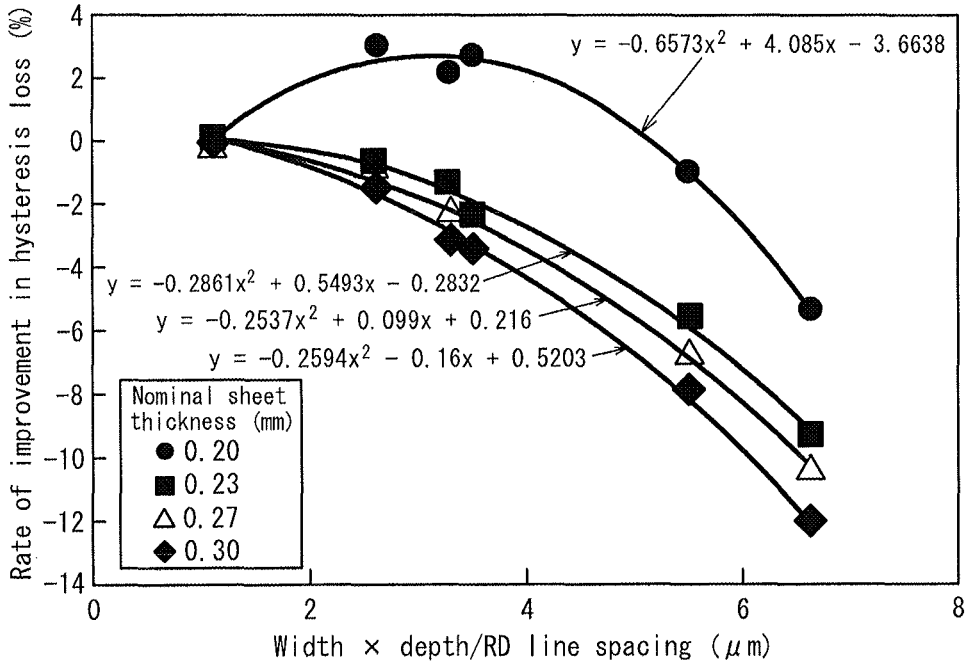
FIG. 5 illustrates the effect of a volume index for the portion where the closure domain is formed (width×depth of the portion where the closure domain is formed/RD line spacing) on the rate of improvement in hysteresis loss with respect to the hysteresis loss when the volume index for the portion where the closure domain is formed is 1.1 μm.
Figure 6:
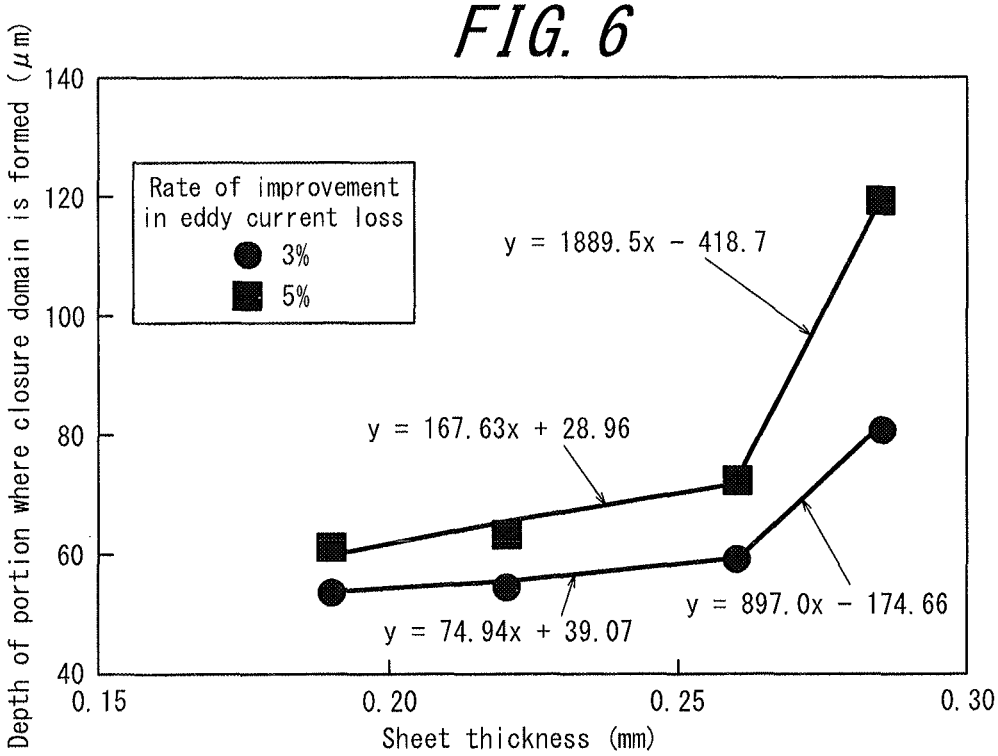
FIG. 6 illustrates the depth of the portion where the closure domain is formed that is necessary to set the rate of improvement in eddy current loss to 3% or 5% (a more preferable condition)

As illustrated in FIG. 6, as conditions to set the rate of improvement in eddy current loss to 3% or 5%, it is preferred for the depth h of the portion where the closure domain is formed to satisfy the following relationships (rate of improvement in eddy current loss: 3%) with the actually measured thickness t (mm) of the steel sheet:

$$h \geq 74.9t + 39.1 (0.26 \geq t), \text{ and}$$

$$h \geq 897t - 174.7 (t > 0.26)$$

and more preferably the following relationships (rate of improvement in eddy current loss: 5%):

$$h \geq 168t + 29.0 (0.26 \geq t), \text{ and}$$

$$h \geq 1890t - 418.7 (t > 0.26).$$

In the present invention, the shape of the cross-sectional closure domain can be measured with a Kerr effect microscope. The (100) face of the crystal is set as the observation face. The reason is that if the observation face is misaligned from the (100) face, a different domain structure is more easily expressed due to a surface magnetic pole occurring on the observation face, making it more difficult to observe the desired closure domain.

Figure 13:
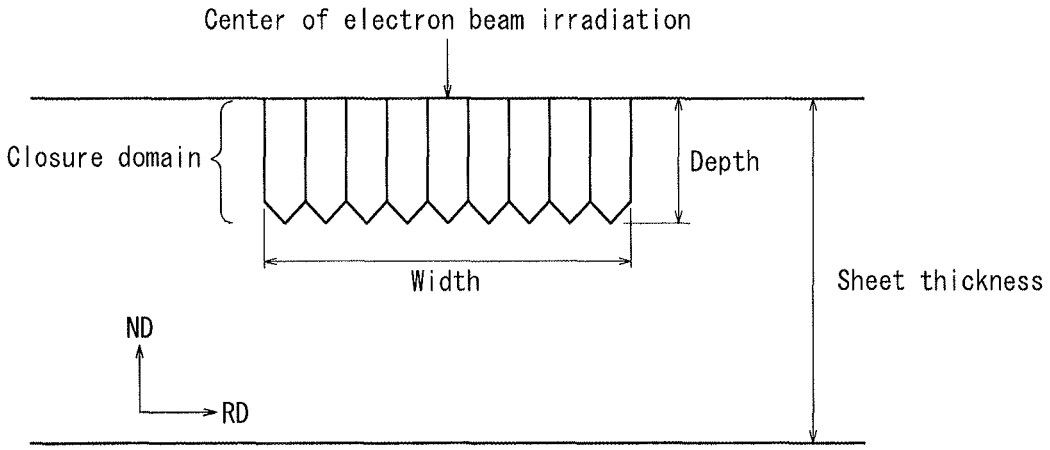
FIG. 13 is a schematic representation of an observational image of the closure domain under a Kerr effect microscope.

When the crystal orientation is accumulated in the ideal Goss orientation, a rolling direction cross-section parallel to the sheet thickness direction is rotated 45° with the rolling direction as the axis of rotation to yield the observation face, and the shape of the closure domain in a rolling direction cross-section parallel to the sheet thickness direction is calculated by conversion from the observed shape of the closure domain. FIG. 13 is a schematic representation of an observational image under a Kerr effect microscope.

Since the region of the closure domain shape corresponds to the region of induced strain, a minute strain distribution in which a closure domain is formed may be observed by x-ray or electron beam and quantified.

As described above, a low closure domain volume is good, yet for a large sheet thickness, deterioration of hysteresis loss due to electron beam irradiation becomes more pronounced, making an even smaller closure domain preferable. Therefore, in the present invention, the sheet thickness is included as a parameter for the appropriate closure domain volume.

As the depth of the closure domain in the sheet thickness direction is larger, the closure domain is more advantageous for improving eddy current loss. For a large sheet thickness, however, domain refinement is difficult, perhaps because the domain wall energy is large. Accordingly, in order to obtain a sufficient magnetic domain refining effect, it is preferred to form a deeper closure domain.

[Electron Beam Generation Conditions]

The following describes the electron beam generation conditions preferred in the present invention.

[Acceleration Voltage Va and P (Irradiation Energy Per Unit Scanning Length/Beam Diameter)]

$$Va \geq 580t + 270 - 6.7P (0.26 \geq t)$$

$$Va \geq 6980t - 1390 - 6.7P (t > 0.26)$$

It is preferred for the acceleration voltage Va (kV) of the electron beam and P (J/m/mm) in embodiments of the present invention to satisfy the above expressions. The reason is that the above-described depth of the portion where the closure domain is formed can be adjusted easily.

As the acceleration voltage is higher, the penetration depth of the electrons in the steel increases, which is advantageous for a deeper closure domain shape. Furthermore, high acceleration voltage is preferable for obtaining a high magnetic domain refining effect in thick sheet material. The depth of the portion where the closure domain is formed also depends, however, on the irradiation energy per unit scanning length/beam diameter (P). When P is large, a narrow region is irradiated with extremely high-density energy. Hence, the electrons penetrate more easily in the sheet thickness direction. For this reason, when P is large, the lower limit on the acceleration voltage decreases.

[P>45 (J/m/mm)]

When the irradiation energy per unit scanning length/beam diameter: P is excessively small, i.e. when the irradiation energy is low to begin with, or when the irradiation energy density is low since both the irradiation energy and the beam diameter are large, then the steel sheet cannot be provided with strain, and the effect of reducing iron loss is lessened. Therefore, in the present invention, P is preferably set to exceed 45. While there is no restriction on the upper limit of P, an excessively large P significantly damages the coating and makes it impossible to ensure an anti-corrosion property. Therefore, the upper limit preferably is approximately 300.

[RD Line Spacing: 3 mm to 12 mm]

The steel sheet is irradiated with the electron beam linearly from one edge in the width direction to the other edge, and the irradiation is repeated periodically in the rolling direction. The spacing (line spacing) s is preferably 3 mm to 12 mm. The reason is that if the line spacing is narrow, the strain region formed in the steel becomes excessively large, and iron loss (hysteresis loss) worsens. On the other hand, if the line spacing is too wide, the magnetic domain refining effect lessens no matter how much the closure domain extends in the depth direction, and iron loss does not improve. Accordingly, in the present invention, the RD line spacing s is preferably set in a range of 3 mm to 12 mm.

[Line Angle: 60° to 120°]

When irradiating the steel sheet linearly from one edge in the width direction to the other edge, the direction from the starting point to the ending point is set to be from 60° to 120° with respect to the rolling direction.

The reason is that if the line angle is less than 60° or more than 120°, the irradiation width increases, causing a drop in productivity. Moreover, the strain region grows large, causing hysteresis loss to worsen.

In the present invention, "linear" refers not only to a straight line, but also to a dotted line or a discontinuous line, and the line angle refers to the angle between the rolling direction and a straight line connecting the starting point with the ending point. In the case of a dotted line or a discontinuous line, the length of the portion not irradiated with the beam between dots along the line or between continuous line segments is preferably 0.8 mm or less. The reason is that if irradiated region is excessively small, the effect of improving the eddy current loss may be lessened.

[Processing Chamber Pressure: 3 Pa or Less]

If the processing chamber pressure is high, electrons emitted from the electron gun scatter, and the energy of the electrons forming the closure domain is reduced. Therefore, the magnetic domain of the steel sheet is not sufficiently refined, and iron loss properties do not improve. Accordingly, in the present invention, the processing chamber pressure is preferably set to 3 Pa or less. In terms of practical operation, the lower limit on the processing chamber pressure is approximately 0.001 Pa.

[Beam Diameter: 400 μm or Less]

The closure domain width and the beam diameter are correlated, and as the beam diameter is smaller, the closure domain width tends to decrease. Accordingly, a small (narrow) beam diameter is good, with a beam diameter of 400 μm or less being preferable. If the beam diameter is too small, however, the steel substrate and coating at the irradiated portion are damaged, dramatically decreasing the insulation properties of the steel sheet. Furthermore, in order to significantly reduce the beam diameter, the WD (distance from the focusing coil to the steel sheet) must be shortened, yet doing so causes the beam diameter to vary excessively in the deflection direction (sheet transverse direction) of the beam. The quality of the steel sheet thus easily becomes uneven in the width direction. Accordingly, the beam diameter is preferably 150 μm or more.

[Material for Source of Thermionic Emission: $LaB_6$]

In general, a $LaB_6$ cathode is known to be advantageous for outputting a high-intensity beam, and since the beam diameter is easily focused, $LaB_6$ is preferably used as the emission source for the electron beam in the present invention.

[Regarding Beam Focusing]

When irradiating by deflecting in the width direction, the focusing conditions (focusing current and the like) are of course preferably adjusted in advance so that the beam is uniform in the width direction.

In the present invention, typical, well-known methods suffice for adjustment of conditions other than those listed above, such as the size of the portion where the closure domain is formed, the irradiation energy, the beam diameter, and the like.

EXAMPLES

In the grain-oriented electrical steel sheet used in the present examples, materials with $W_{17/50}$ of 0.80 W/kg to 0.90 W/kg (t: 0.19 mm, 0.26 mm) and 0.90 W/kg to 1.00 W/kg (t: 0.285 mm) were irradiated with an electron beam. The electron beam had a line angle of 90° and a processing chamber pressure of 0.1 Pa. Table 1 lists the other irradiation conditions and the closure domain shape after irradiation.

TABLE 1

| No. | Sheet thickness (mm) | Beam cathode material | Acceleration voltage (kV) | Line spacing (mm) | Beam diameter (μm) | Irradiation energy per unit length (J/m) | P (J/m/mm) | Closure domain width (μm) | Closure domain depth (μm) |
|---|---|---|---|---|---|---|---|---|---|
| 1 | 0.26 | $LaB_6$ | 60 | 4.0 | 320 | 17 | 53 | 250 | 50 |
| 2 | 0.26 | $LaB_6$ | 150 | 3.5 | 320 | 18 | 55 | 255 | 65 |
| 3 | 0.26 | $LaB_6$ | 150 | 6.0 | 320 | 21 | 66 | 270 | 70 |
| 4 | 0.26 | $LaB_6$ | 150 | 3.5 | 350 | 15 | 43 | 230 | 55 |
| 5 | 0.26 | $LaB_6$ | 60 | 5.0 | 350 | 23 | 66 | 275 | 65 |
| 6 | 0.26 | $LaB_6$ | 60 | 6.0 | 320 | 24 | 75 | 280 | 75 |
| 7 | 0.285 | $LaB_6$ | 70 | 5.0 | 240 | 16 | 68 | 230 | 65 |
| 8 | 0.285 | $LaB_6$ | 150 | 6.0 | 350 | 19 | 54 | 270 | 65 |
| 9 | 0.285 | $LaB_6$ | 150 | 5.0 | 260 | 19 | 73 | 250 | 85 |
| 10 | 0.285 | $LaB_6$ | 70 | 4.0 | 310 | 20 | 64 | 270 | 65 |
| 11 | 0.285 | $LaB_6$ | 60 | 6.0 | 230 | 20 | 87 | 275 | 85 |
| 12 | 0.285 | $LaB_6$ | 150 | 6.0 | 200 | 18 | 88 | 250 | 100 |
| 13 | 0.285 | $LaB_6$ | 150 | 6.0 | 140 | 15 | 107 | 155 | 120 |
| 14 | 0.285 | W (Tungsten) | 80 | 6.0 | 420 | 21 | 51 | 265 | 45 |
| 15 | 0.285 | W (Tungsten) | 150 | 6.0 | 240 | 20 | 83 | 265 | 90 |
| 16 | 0.26 | $LaB_6$ | 70 | 5.0 | 420 | 28 | 67 | 270 | 65 |
| 17 | 0.19 | $LaB_6$ | 70 | 5.0 | 290 | 22 | 76 | 265 | 65 |
| 18 | 0.19 | $LaB_6$ | 30 | 5.0 | 360 | 18 | 50 | 280 | 45 |

Next, the closure domain shape of these steel sheets, No. 1 to 18, was evaluated according to the assessments below, and the iron loss $W_{17/50}$ was measured. The measurement results and the like are shown in Table 2. Note that the depth and the width of the closure domain are respectively h (μm) and w (μm), and the RD line spacing is s (mm). The iron loss is the average of measurements for 15 sheets under each set of conditions.

Assessment 1:

Volume: $(w \times h)/(s \times 1000) \leq -12.6t+7.9$ ($t$:0.26 mm,0.285 mm)

$(w \times h)/(s \times 1000) \leq -40.6t+14.1$ ($t$:0.19 mm)

Depth: $h \geq 74.9t+39.1$ (actually measured sheet thickness ($t$): 0.19 mm,0.26 mm)

Depth: $h \geq 897t-174.7$ (actually measured sheet thickness ($t$): 0.285 mm)

Assessment 2:

Volume: $(w \times h)/(s \times 1000) \leq -12.3t+6.9$ ($t$:0.26 mm,0.285 mm)

$(w \times h)/(s \times 1000) \leq -56.1t+16.5$ ($t$:0.19 mm)

Depth: $h \geq 168t+29.0$ (actually measured sheet thickness ($t$): 0.19 mm,0.26 mm)

Depth: $h \geq 1890t-418.7$ (actually measured sheet thickness ($t$): 0.285 mm)

TABLE 2

| No. | P assessment | Va assessment | Volume assessment 1 | Volume assessment 2 | Depth assessment 1 | Depth assessment 2 | Overall assessment 1 | Overall assessment 2 | W17/50 (W/kg) | Notes |
|---|---|---|---|---|---|---|---|---|---|---|
| 1 | pass | fail | pass | pass | fail | fail | fail | fail | 0.751 | Comparative example |
| 2 | pass | pass | fail | fail | pass | fail | fail | fail | 0.748 | Comparative example |
| 3 | pass | pass | pass | pass | pass | fail | pass | fail | 0.737 | Inventive example |
| 4 | fail | pass | pass | pass | fail | fail | fail | fail | 0.744 | Comparative example |
| 5 | pass | pass | pass | pass | pass | fail | pass | fail | 0.739 | Inventive example |
| 6 | pass | pass | pass | pass | pass | pass | pass | pass | 0.735 | Inventive example |
| 7 | pass | fail | pass | pass | fail | fail | fail | fail | 0.855 | Comparative example |
| 8 | pass | fail | pass | pass | fail | fail | fail | fail | 0.858 | Comparative example |
| 9 | pass | pass | pass | fail | pass | fail | pass | fail | 0.849 | Inventive example |
| 10 | pass | fail | fail | fail | fail | fail | fail | fail | 0.858 | Comparative example |
| 11 | pass | pass | pass | fail | pass | fail | pass | fail | 0.849 | Inventive example |
| 12 | pass | pass | pass | fail | pass | fail | pass | fail | 0.844 | Inventive example |
| 13 | pass | pass | pass | pass | pass | pass | pass | pass | 0.836 | Inventive example |
| 14 | pass | fail | pass | pass | fail | fail | fail | fail | 0.851 | Comparative example |
| 15 | pass | pass | pass | fail | pass | fail | pass | fail | 0.848 | Inventive example |
| 16 | pass | pass | pass | pass | pass | fail | pass | fail | 0.740 | Inventive example |
| 17 | pass | pass | pass | pass | pass | pass | pass | pass | 0.668 | Inventive example |
| 18 | pass | fail | pass | pass | fail | fail | fail | fail | 0.682 | Comparative example |

Table 2 shows that applying the present technique yields a grain-oriented electrical steel sheet with low iron loss, such that $W_{17/50}$ is 0.68 W/kg or less (t: 0.19 mm), 0.74 W/kg or less (t: 0.26 mm), or 0.85 W/kg or less (t: 0.285 mm).

The invention claimed is:

1. A grain-oriented electrical steel sheet with an actually measured sheet thickness t (mm), comprising a closure domain region extending linearly in a direction from 60° to 120° with respect to a rolling direction on a surface of the steel sheet, the closure domain region corresponding to a region of induced strain and being formed periodically at a spacing s (mm) in the rolling direction, wherein $w \geq 230$ μm, $h \geq 168t+29.0$ $(0.26 \geq t)$, $h \geq 1890t-418.7$ $(t>0.26)$, $(w \times h)/(s \times 1000) \leq -12.3t+6.9$ $(t>0.22)$, and $(w \times h)/(s \times 1000) \leq -56.1t+16.5$ $(t \leq 0.22)$, where h (μm) is a depth and w (μm) is a width of the closure domain region, s (mm) is the spacing, and t (mm) is the actually measured sheet thickness.

2. A method for manufacturing the grain-oriented electrical steel sheet with an actually measured sheet thickness t (mm) of claim 1, comprising forming a closure domain region extending linearly in a direction from 60° to 120° with respect to a rolling direction on a surface of the steel sheet, the closure domain region corresponding to a region of induced stain and being formed periodically at a spacing s (mm) in the rolling direction, by using an electron beam emitted at an acceleration voltage Va (kV), wherein $w \geq 230$ μm, $h \geq 168t+29.0$ $(0.26 \geq t)$, $h \geq 1890t-418.7$ $(t>0.26)$, $(w \times h)/(s \times 1000) \leq -12.3t+6.9$ $(t>0.22)$, and $(w \times h)/(s \times 1000) \leq -56.1t+16.5$ $(t \leq 0.22)$, where h (μm) is a depth and w (μm) is a width of the closure domain region, s (mm) is the spacing, and t (mm) is the actually measured sheet thickness, and $Va \geq 580t+270-6.7P$ $(0.26 \geq t)$, $Va \geq 6980t-1390-6.7P$ $(t>0.26)$, and $P>45$, where P is irradiation energy per unit scanning length/beam diameter (J/m/mm).

3. The method of claim 2, wherein the beam diameter of the electron beam is 400 μm or less.

4. The method of claim 2, wherein a $LaB_6$ cathode is used as an irradiation source of the electron beam.

5. The method of claim 3, wherein a $LaB_6$ cathode is used as an irradiation source of the electron beam.

* * * * *